US008202020B2

(12) United States Patent
Hughes, Jr.

(10) Patent No.: US 8,202,020 B2
(45) Date of Patent: Jun. 19, 2012

(54) TRAFFIC CONTROL MARKER WITH DELINEATOR AND GROUND STAKE

(76) Inventor: Robert K. Hughes, Jr., Fort Myers, FL (US)

( * ) Notice: Subject to any disclaimer, the term of this patent is extended or adjusted under 35 U.S.C. 154(b) by 407 days.

(21) Appl. No.: 12/623,144

(22) Filed: Nov. 20, 2009

(65) Prior Publication Data

US 2010/0135722 A1 Jun. 3, 2010

Related U.S. Application Data

(60) Provisional application No. 61/116,464, filed on Nov. 20, 2008.

(51) Int. Cl.
*E01F 9/00* (2006.01)

(52) U.S. Cl. ..... 404/9; 40/606.01; 40/607.1; 40/612; 116/63 R

(58) Field of Classification Search ..... 40/606.01, 40/607.01, 607.1, 612; 404/9, 10, 12, 13; 116/63 R See application file for complete search history.

(56) References Cited

U.S. PATENT DOCUMENTS

| | | | | |
|---|---|---|---|---|
| 4,364,688 | A * | 12/1982 | Bitvai | 404/10 |
| 4,522,530 | A * | 6/1985 | Arthur | 404/10 |
| 4,862,823 | A | 9/1989 | Hughes | |
| 5,197,819 | A | 3/1993 | Hughes | |
| 5,277,146 | A | 1/1994 | Hughes, Jr. | |
| 5,439,311 | A | 8/1995 | Hughes, Jr. | |
| 5,452,965 | A | 9/1995 | Hughes, Sr. | |
| 6,109,820 | A | 8/2000 | Hughes, Sr. | |
| 6,732,673 | B2 | 5/2004 | Hughes, Sr. et al. | |
| 2008/0295375 | A1 * | 12/2008 | Intagliata et al. | 40/608 |
| 2009/0279951 | A1 * | 11/2009 | Wheeler, Jr. | 404/10 |
| 2010/0254761 | A1 * | 10/2010 | Wheeler, Jr. | 404/10 |

* cited by examiner

*Primary Examiner* — Gary S Hartmann
(74) *Attorney, Agent, or Firm* — Bracewell & Giuliani LLP

(57) ABSTRACT

A traffic control assembly for marking roadways or other marking areas is shown generally having a base, a stake, a pin, a collar, and a flexible marker that extends substantially vertically from the base when in a non-impacted and non-deformed state. The pin passes through pin holes in the stake, collar, and marker when the traffic assembly is installed. The traffic control assembly has fewer parts and is thus easier to install and replace. The pin is in contact with the base to provide support to the stake and prevent it from listing when the assembly is struck by a vehicle.

20 Claims, 5 Drawing Sheets

TRAFFIC CONTROL MARKER WITH DELINEATOR AND GROUND STAKE

CROSS-REFERENCE TO RELATED APPLICATION

This application claims priority to provisional application 61/116,464 filed Nov. 20, 2008.

BACKGROUND OF THE INVENTION

1. Technical Field

The present invention relates in general to traffic control markers and, in particular, to a traffic control marker having a delineator and steel ground stake.

2. Description of the Related Art

Traffic control devices used on roadways or other marking areas are frequently struck by vehicles. If the traffic control device is not adequately secured in place, the device is often displaced from its intended location. Examples of commonly used traffic control devices include traffic cones. To prevent inadvertent displacement of traffic control devices such as traffic cones, a traffic control device is needed that remains in place even when struck by a vehicle.

Another type of traffic control device is a flexible, strap-like highway marker that is secured within a base. Such traffic control devices, however, feature many parts and require multiple steps to properly assemble and install the traffic control device. Additionally, each of the parts included in such these devices are naturally subject to wear over time.

Thus, it would be desirable provide a flexible highway marker that reduces the number of parts required for assembly, while also reducing the number of steps required to properly install or replace the marker device, and maintaining the performance as known types of flexible highway markers when vehicles deflect them on the roadway or other marking area.

SUMMARY OF THE INVENTION

In an embodiment of the present invention, a traffic control device for marking roadways or other marking areas is shown generally having a base, a stake assembly, a pin, a collar, and a flexible marker that extends substantially vertically from the base when in a non-impacted and non-deformed state. The base may have a slot in a central hub that receives a stake which is placed in a road surface to anchor the device. The base has a top and bottom surface, with the top surface having a recess in which the collar is received, in this embodiment. An upper portion of the collar is open to receive and seat a flange located at a lower portion of the marker. The stake may be fabricated from a steel, U-shaped channel.

Once a set of pin holes in the stake, collar, and flange are aligned, a pin is laterally passed through the pin holes in the stake, collar, and flange. The traffic control assembly has fewer parts and is thus easier to install and replace.

When struck by a vehicle, the flexible marker will deflect until the vehicle has passed over it. The pin, which has a reaction point at the point of contact with the base, holds the marker in the base to prevent it from becoming detached, thereby allowing the marker to return to a substantially upright position. The pin and base further provide support to the stake and prevent it from moving or listing when the assembly is struck by a vehicle.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
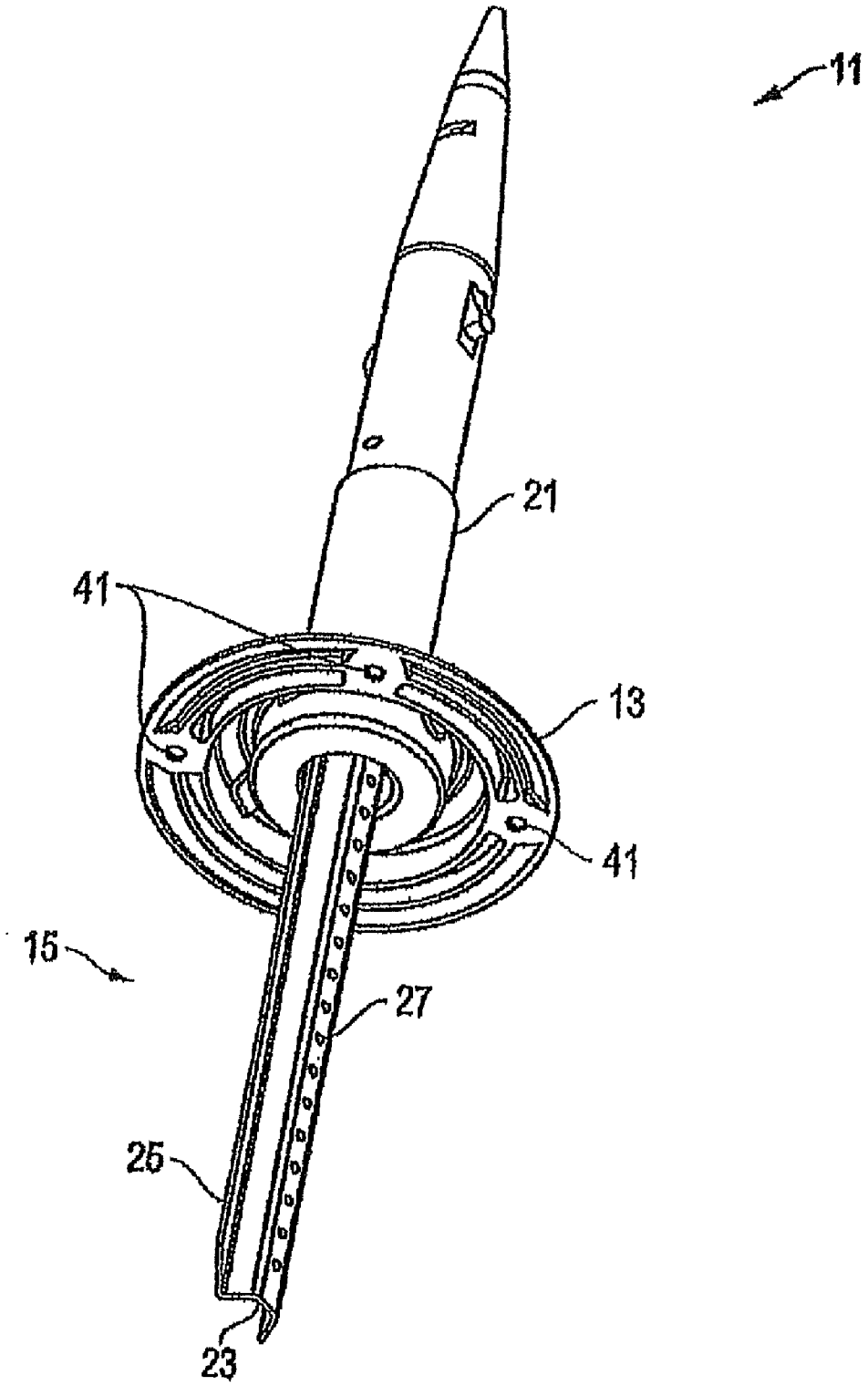
FIG. 1 is an isometric view of one embodiment of a delineator traffic marker constructed in accordance with the invention.

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Referring to FIGS. 1-4, embodiments of a system, method and apparatus for a traffic control marker are shown. A traffic control assembly 11 for marking roadways or other marking areas is shown. The embodiment of the traffic control assembly 11 generally includes a base 13, a stake 15, a pin 17, a collar 19, and a flexible marker 21 that extends substantially vertically from the base 13 when in a non-impacted and non-deformed state.

Figure 2:
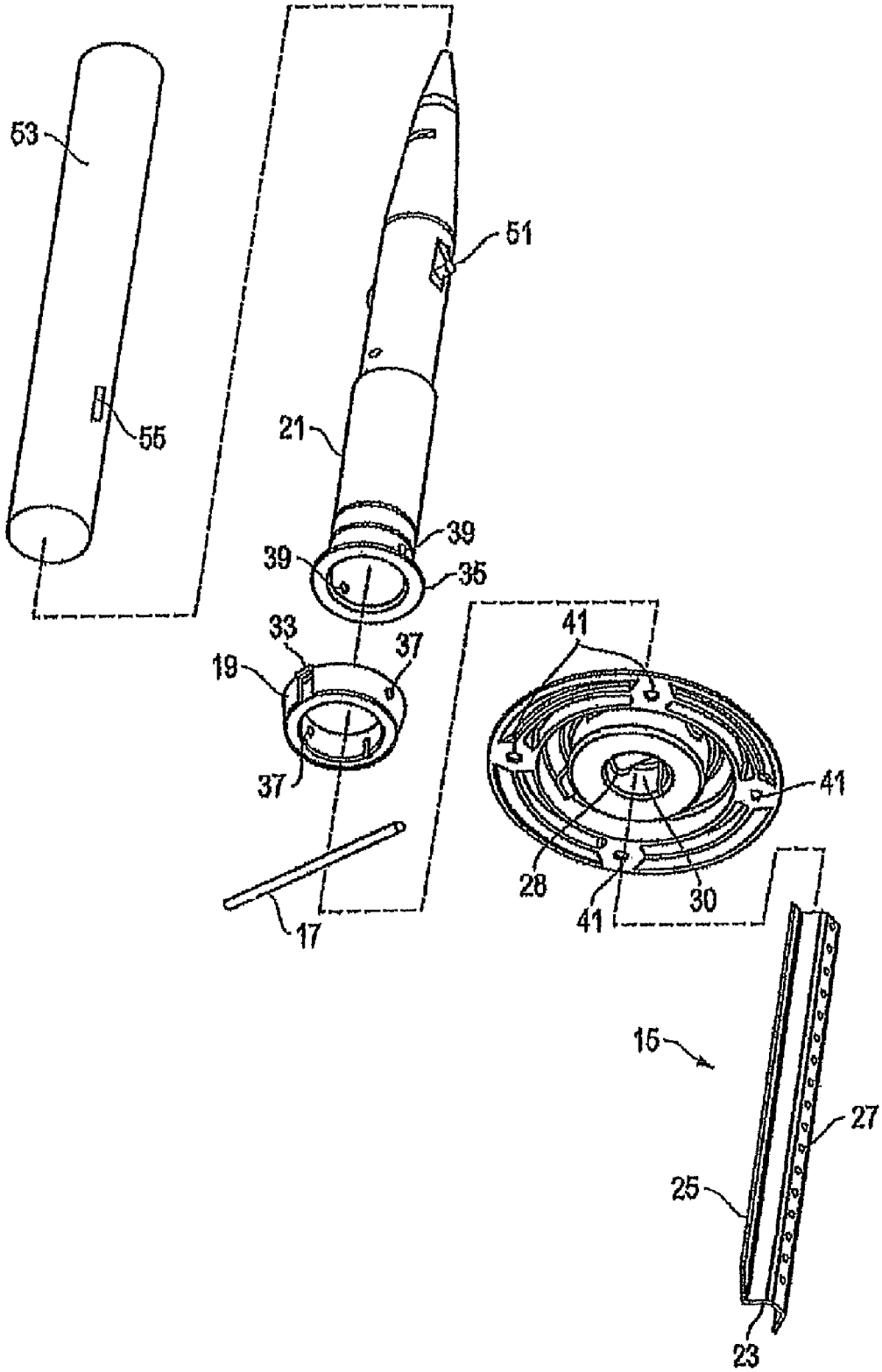
FIG. 2 is an exploded isometric view of one embodiment of the delineator traffic marker of FIG. 1 and is constructed in accordance with the invention.
Figure 3:
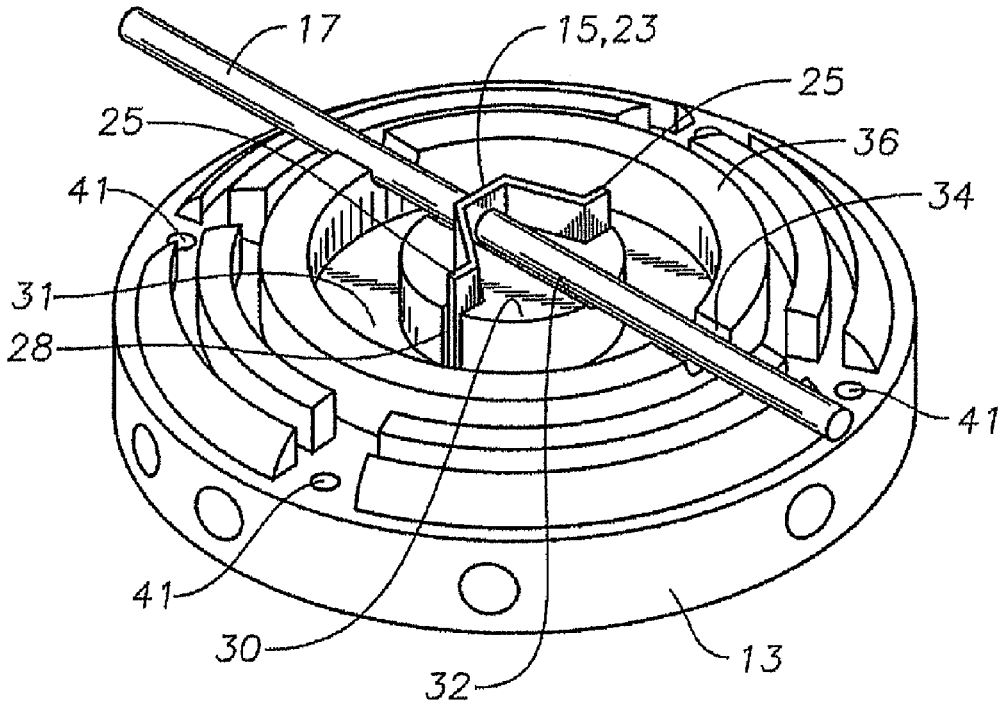
FIG. 3 is an enlarged isometric view of one embodiment of a lower portion of the delineator traffic marker of FIG. 1 and is constructed in accordance with the invention.

The base 13 may comprise a flat cylindrical and conical shape as shown, or configured square, rectangular, or alternatively any other suitable shape. The base 13 is designed to be secured to a roadway with the stake 15. As best shown in FIGS. 2 and 3, the stake 15 may comprise a steel, u-shaped channel 23 with parallel flanges 25 on both sides, and a series of holes 27 extending along the length of u-shaped channel 23. Alternatively, the stake 15 may comprise other materials, such as plastic. The base may comprise other profiles, such as square, round, elongated oval or still other shapes. These various shapes may be suitable for uneven terrain to better stabilize the stake when the surface of the supporting ground is not level. For example, on a roadway having a sloped shoulder, a base with an elongated shape (e.g., oval 4 inches by 18 inches), with the long side of the base parallel to the roadway, may be used to better follow the contour of the shoulder in which the marker is located, and to aid in preventing listing of the stake 25 when struck by a vehicle.

In another embodiment, only the uppermost hole 27 in stake 15 is minimally required to retain the device. The stake 15 may be provided with a length of approximately 6 to 24 inches, and an overall width of about two inches. An upper portion of the stake 15 extends through a complementary-shaped slot 28 formed in a central hub 30 of the base 13. The stake 15 may extend above the hub 30 by a distance of about 1/16-inch to about 12-inches above ground, depending on the application. An upper end of the hub 30 may also have a radially extending channel 32 that receives the pin 17 and aids in preventing the pin 17 from rotating.

The base may also have a cylindrical recess 31 formed in its upper surface between hub 30 and the outer portion of base 13. The collar 19 has a donut-shaped configuration that seats in the recess 31 to circumscribe the hub 30. Collar 19 may be provided with an alignment feature 33 that is complementary to a feature on base 15 to orient collar 19 relative to base 13 and stake 15. In this embodiment, the upper end of collar 19 is open for receiving and seating a small, circumferential flange 35 located at the bottom of marker 21. Both collar 19 and marker 21 are provided with through holes 37, 39, respectively. Base 13 also may be provided with such holes or features. Significantly, the base 13 prevents the stake 15 from listing or extraneous movement once these components are secured together. In effect, this design keeps the portion of the stake 15 that is above ground from listing as well, and substantially maintains a perpendicular relationship there between.

The base may also have a recess 34 formed on an outer wall 36. The outer wall 36 extends upward from the base 13 and encircles the hub 30. The recess 34 is configured to receive the pin 17 when installed and provides a reaction point for the pin 17 to hold the marker 21, collar 19, stake 15, and base 13 together and secured to the ground. Further, the recess 34 on the outer wall 36 restricts the rotational movement of the pin 17.

Stake 15 is driven into the ground such that only a few inches of its length extend about the surface of the ground. The base 13 is then placed on the stake 15 such that the upper portion of the stake is positioned in slot 28. Next, the collar 19 is placed in the recess 31 with the open upper surface of the collar facing upward. The bottom or flange 35 of the marker 21 is then placed in the collar such that holes 37 and 39 align with one of the holes 27 formed in the stake 15. The pin 17 is then extended laterally through the holes 37, 39, 27 to secure the entire assembly to each other and to the ground. Recesses or holes may also be formed on the base 13 to hold the pin 17 in place. The pin 17 may be in contact with the top surface of the base 13 to provide a reaction point that supports the various pieces of the assembly 11 and prevents the stake 15 from moving in the ground or road surface.

In one embodiment, the upper portion of marker 21 comprises a pair of ears 51 that are locking retention features for retaining a reflective component 53. For example, reflective component 53 may comprise a tubular member as shown with indicia for greater visibility to traffic. The ears 51 are resilient members that slip through component 53 and lock into holes 55 formed in the sides thereof. After component 53 is installed on marker 21, it may be removed by cutting or deforming component 53 and replaced.

Although not used in this application, the base 15 also includes four holes 41 that are spaced apart about its outer circumference. In other types of applications, the holes 41 provide an alternate option for the base 13 to be mounted to a roadway or other marking area with fasteners.

In one embodiment, which is one of many possible embodiments, the flexible marker 21 has a vertically extending length of about 3 feet, and a thickness of about 3 or 4 inches in an elongated cylindrical and conical profile. The flexible marker 21 is a visibly coated warning device. When placed on a roadway, the base 13, stake 15, pin 17 and collar 19 are designed to support the flexible marker 21 in an upright position during normal non-impacted use, and thus alert automobile drivers of roadway conditions. The flexible marker 21 may have a smooth outer surface, or alternatively may be ribbed with longitudinal stiffening ribs along its length. The flexible marker 21 may also be curved, oblong, or tubular in shape.

The flexible marker 21 is sufficiently thick to resist casual bending or flexing along its length from forces such as a strong wind. As such, the marker 21 remains substantially vertically upright when in a non-deformed state when the marker 21 is not forcibly impacted by a physical object. The flexible marker 21 is sufficiently flexible so that the marker 25 will elastically deform along its length when a physical object forcibly applies a significant impact on the flexible marker 21, such as by a moving vehicle or automobile.

Figure 4A:
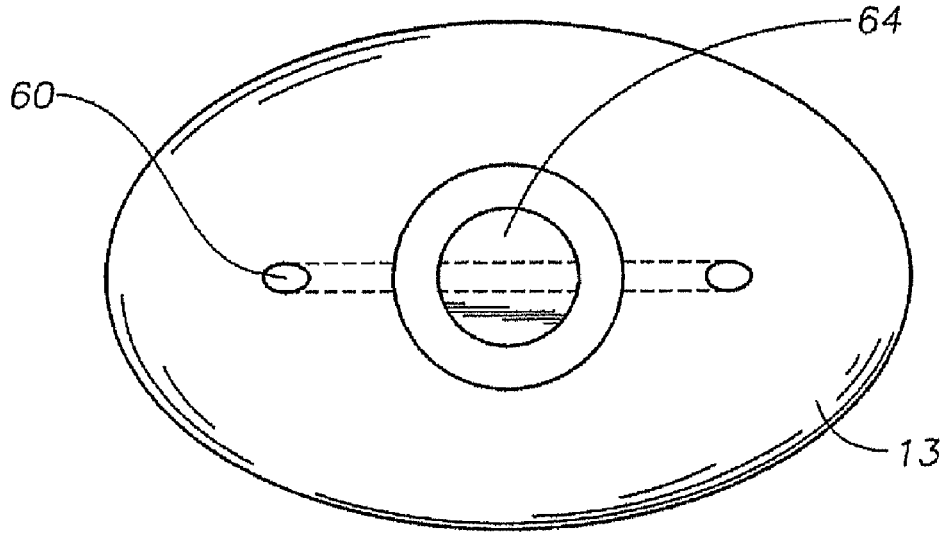
FIG. 4A is an isometric view the traffic marker of FIG. 4 in accordance with the invention.
Figure 4:
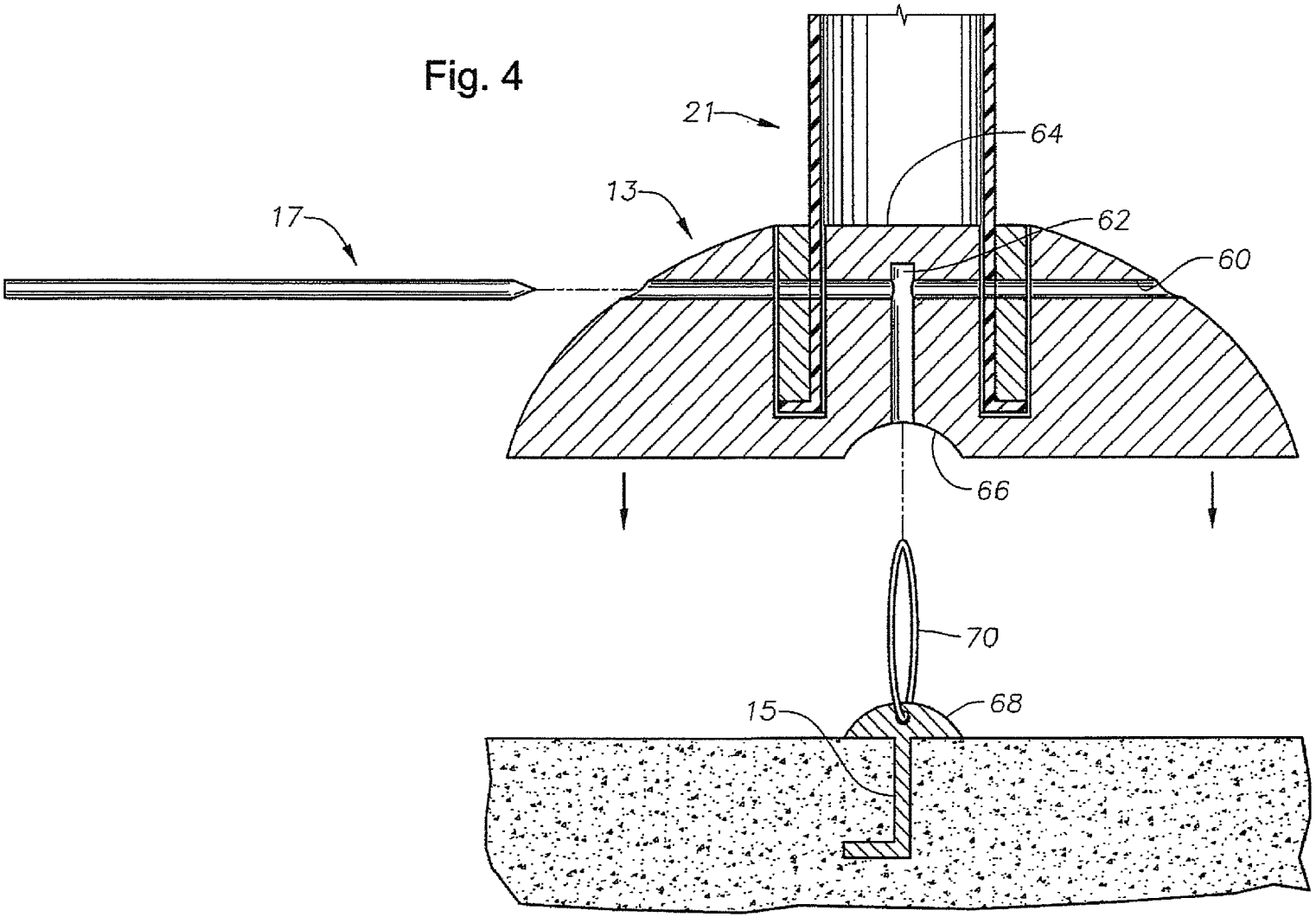
FIG. 4 is a side view of another embodiment of base of the delineator traffic marker utilizing a ring at the top of the stake and is constructed in accordance with the invention.
Figure 5:
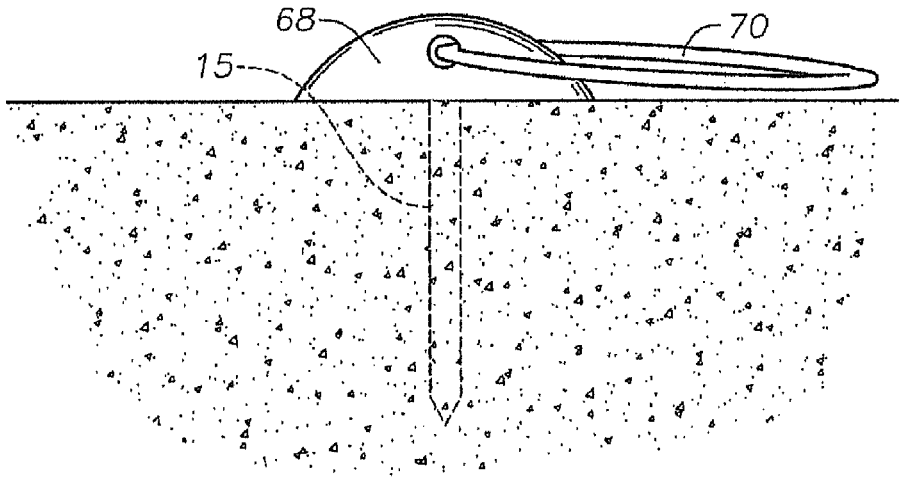
FIG. 5 is a side view of the ring in FIG. 4 at the top of the stake when the base is removed, and is constructed in accordance with the invention.
Figure 6:
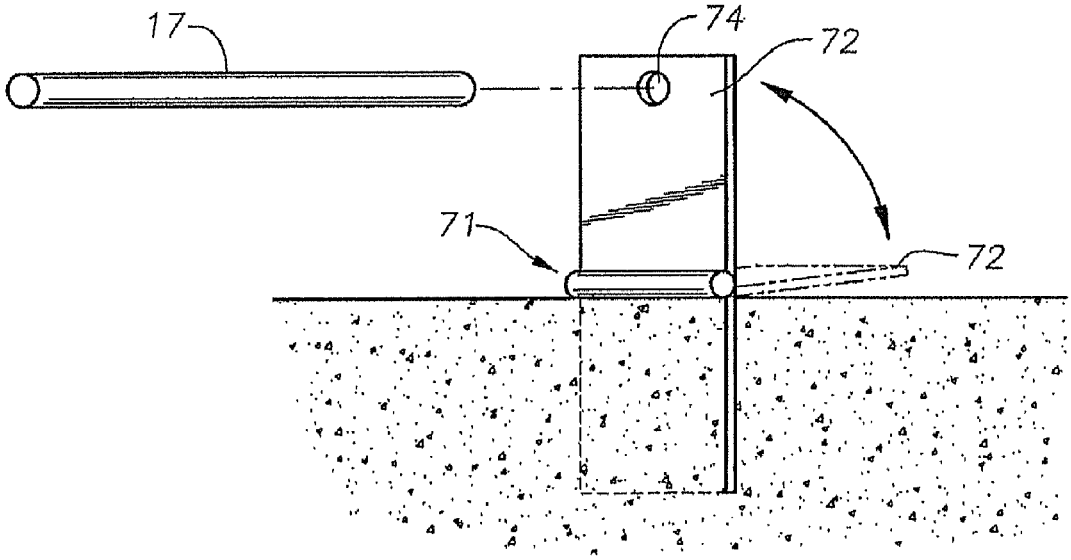
FIG. 6 is an isometric view of a hinge that can be utilized as a stake in accordance with the inventions.

In another embodiment shown in FIGS. 4, 4A, and 5, a conical base 13 is illustrated having a pin hole 60 that runs through its body for receiving the pin 17. The base 13 has a slot 62 formed within a hub 64. The upper portion of the slot 62 intersects with the pin hole 60 at approximately a right angle. The bottom portion of the slot 62 terminates at a concave recess 66 formed on the bottom surface of the base 13. The slot 62 may also traverse through the entire hub 64. The concave recess 66 corresponds to a rounded ring retainer 68 that is secured to a stake 15 in the road surface. The stake 15 may have an L-shape or a shape as shown in FIG. 1 or FIG. 5. A ring 70 pivots about a passage in the ring retainer 68. The ring retainer 68 and the ring 70 may be steel or plastic. FIG. 4A illustrates an embodiment for a base 13 having an oval shape, with an elongated side and a short side.

During installation, the ring 70 is received by the slot 62 in the base 13 to a point at which the rounded ring retainer 68 is seated against the concave recess 66. The upper portion of the ring 70 will be located a sufficient distance past the intersection of the slot 62 with the pin hole 60 such that the pin 17 will pass through the ring 70. If the base 13 is removed or detached, the ring 70 will fall to the road surface as it pivots about the passage in the ring retainer 68, as shown in FIG. 5. Further, the rounded ring retainer 68 will remain secured to the top end of the stake 15 to prevent tire damage that could be caused by an exposed stake 15.

Alternatively, a hinge 71 could be used by itself or together with a stake 15 (FIG. 5). The bottom portion of the hinge may be anchored to the road surface and the upper portion 72 can pivot at a point approximately at the level of the road surface. In this embodiment, the upper portion 72 of the hinge 71 has a hole 74 approximately at its non-pivoting end for receiving a pin once the upper portion 72 is located within the slot 62 (FIG. 4). As with the ring 70 (FIG. 5), the upper portion 72 of the hinge 71 will fall to the road surface if the base 13 is removed or detached. The upper portion 72 will thus be flat on the road surface and will help prevent tire damage that can be caused by an exposed stake 15.

In operation, when a moving vehicle (not shown) strikes the traffic control assembly 11, it is designed to allow the flexible marker 21 to elastically deform before returning to an upright position after impact. When the tire of the vehicle strikes the traffic control assembly 11, the tire rolls onto the conical portion of the base 13 before striking the flexible marker 21. The shape of the base 13 elevates the tire above the stake 15 to prevent the stake 15 from puncturing the tire. Upon impact from the tire, the marker 21 flexes or bends. The bottom portion of the flexible marker 21 remains securely affixed to base 13. After the vehicle and tire move past the traffic control assembly 11, the resilient elastic properties of the flexible marker 21 allow it to return to an upright position.

The invention has several important advantages. The traffic control assembly effectively warns automobile drivers of the condition or presence of the roadway, such that when impacted the traffic control assembly is not displaced from its previous intended position. The invention minimizes the number of parts required to construct the traffic control assembly. The invention also minimizes the number of steps required to properly assemble the traffic control assembly. Further, while minimizing the number of parts and steps of assembly, the invention maintains the same optimum performance as the previous wide flexible highway markers in the industry when vehicles deflect them on the roadway or on another marking area.

While the invention has been shown or described in only some of its forms, it should be apparent to those of ordinary skill in the art that it is not so limited, but is susceptible to various changes without departing from the scope of the invention.

The invention claimed is:

1. A mounting base for supporting a marker comprising:

a base having a top surface and a bottom surface, the bottom surface suitable for attaching the base to ground;

a stake assembly suitable for placement in the ground;

a hub formed on the top surface of the base, the hub having a slot to receive a complementary-shaped portion of the stake assembly;

a cylindrical recess formed on the top surface of the base plate for receiving a lower portion of the marker; the recess located approximately between the hub and the outer portion of the base; and a pin passing through a set of aligned pin holes in the lower portion of the marker and the stake assembly, the pin securing the marker and the stake assembly to each other and to the ground, the pin in contact with the base to provide a reaction point for support and to prevent the stake assembly from moving.

2. The mounting base of claim 1, further comprising a collar, the collar circumscribing the hub and having an upper portion suitable for receiving a lower portion of the marker.

3. The mounting base of claim 1, wherein the base has an oval shape with an elongated side and a short side, the elongated side being parallel to the road surface.

4. The mounting base of claim 1, wherein an upper end of the hub has a radially extending channel that receives the pin.

5. The mounting base of claim 2, wherein the lower portion of the marker has a flange, the flange received by the upper portion of the collar and seated in the collar.

6. The mounting base of claim 1, wherein the stake assembly comprises:

a U-shaped channel having parallel flanges on both sides, the channel having a plurality of holes extending along the length the channel, the holes capable of receiving the pin, the pin extending through one of the holes.

7. The mounting base of claim 1, wherein the stake assembly comprises:

a hinge having an upper and lower portion, the lower portion anchored to the ground and a pivot point located approximately at a level of a road surface, the upper portion being received by the slot in the hub and having a hole to receive the pin during installation, the upper portion pivoting to the road surface to remain approximately flat when the base is removed or detached.

8. The mounting base of claim 1, wherein at least one recess is formed on an outer wall extending upward from the base and encircling the hub, the recess configured to receive the pin when installed, the at least one recess providing a reaction point for the pin to hold the marker, stake assembly, and base together and secured to the ground, the at least one recess restricting the rotational movement of the pin.

9. The mounting base of claim 2, wherein the collar has an alignment mechanism that orients the stake assembly in a selected direction relative to the base so that the holes in the collar align with the hole in the stake assembly.

10. The mounting base of claim 1, wherein the stake assembly further comprises:

a stake inserted in the ground;

a ring retainer secured to a top end of the stake, the ring retainer covering the top end of the stake; and a ring pivotally secured to the ring retainer, the ring having a shape complementary to the slot, the ring opening axially aligned to receive the pin during installation.

11. A traffic control device comprising:

a base having a top surface and a bottom surface, the bottom surface suitable for attaching the base to ground;

a stake assembly suitable for placement in the ground;

a hub formed on the top surface of the base, the hub having a slot to receive a complementary-shaped portion of the stake assembly;

a collar circumscribing the hub and having an upper portion suitable for receiving a lower portion of the marker;

a cylindrical recess formed on the top surface of the base plate for receiving the collar; the recess located approximately between the hub and the outer portion of the base; and a pin passing through a set of aligned pin holes in the lower portion of the marker and the stake assembly, the pin securing the marker and the stake assembly to each other and to the ground, the pin in contact with the base to provide a reaction point for support and to prevent the stake assembly from moving.

12. The traffic control device of claim 11, wherein the lower portion of the marker has a flange, the flange received by the upper portion of the collar and seated in the collar.

13. The traffic control device of claim 11, wherein the base has an oval shape with an elongated side and a short side, the elongated side being parallel to the road surface.

14. The traffic control device of claim 11, wherein a single pin passes from one side of the base to the other.

15. The mounting base of claim 11, wherein the stake assembly comprises:

a U-shaped channel having parallel flanges on both sides, the channel having a plurality of holes extending along the length the channel, the holes capable of receiving the pin, the pin extending through one of the holes.

16. The mounting base of claim 11, wherein the stake assembly comprises:

a hinge having an upper and lower portion, the lower portion anchored to the ground and a pivot point located approximately at a level of a road surface, the upper portion being received by the slot in the hub and having a hole to receive the pin during installation, the upper portion pivoting to the road surface to remain approximately flat when the base is removed or detached.

17. The mounting base of claim 11, wherein an upper end of the hub has a radially extending channel that receives the pin; and wherein at least one recess is formed on an outer wall extending upward from the base and encircling the hub, the recess configured to receive the pin when installed, the at least one recess providing a reaction point for the pin to hold the marker, collar, stake, and base together and secured to the ground, the at least one recess restricting the rotational movement of the pin.

18. The mounting base of claim 11, wherein the collar has an alignment mechanism that orients the stake assembly in a selected direction relative to the base so that the holes in the collar align with the hole in the stake assembly.

19. The mounting base of claim 11, wherein the stake assembly further comprises:

a stake inserted in the ground;

a ring retainer secured to a top end of the stake, the ring retainer covering the top end of the stake; and a ring pivotally secured to the ring retainer, the ring having a shape complementary to the slot, the ring opening axially aligned to receive the pin during installation.

20. A method of installing a traffic control device comprising:

driving a stake assembly into ground;

positioning a base above the stake assembly such that a slot formed in the base receives a complementary-shaped portion of the stake;

locating a bottom portion of a marker within a cylindrical recess formed between a hub and an outer portion of the base;

aligning a hole in the stake assembly with holes in the bottom portion of the marker; and passing a pin through the holes in the bottom portion of the marker and the hole in the stake assembly to secure the marker to the stake assembly and prevent the stake assembly from moving.

* * * * *